US008241201B2

(12) United States Patent
Hakansson

(10) Patent No.: US 8,241,201 B2
(45) Date of Patent: Aug. 14, 2012

(54) IMPLANTABLE TRANSDUCER

(75) Inventor: Bo Hakansson, Göteborg (SE)

(73) Assignee: Osseofon AB, Goteborg (SE)

( * ) Notice: Subject to any disclaimer, the term of this patent is extended or adjusted under 35 U.S.C. 154(b) by 634 days.

(21) Appl. No.: 12/388,618

(22) Filed: Feb. 19, 2009

(65) Prior Publication Data

US 2009/0209806 A1 Aug. 20, 2009

(30) Foreign Application Priority Data

Feb. 20, 2008 (SE) ..... 0800390

(51) Int. Cl.
*H04R 25/00* (2006.01)

(52) U.S. Cl. ..... 600/25; 600/28; 600/378; 600/559; 607/45; 607/57; 381/151; 381/173; 381/181; 381/326; 381/328

(58) Field of Classification Search ..... 600/25, 600/28, 378, 559; 607/45, 57; 381/151, 381/173, 181, 326, 328
See application file for complete search history.

(56) References Cited

U.S. PATENT DOCUMENTS

| | | | | |
|---|---|---|---|---|
| 4,498,461 | A | 2/1985 | Hakansson | |
| 4,612,915 | A | 9/1986 | Hough et al. | |
| 4,652,702 | A | 3/1987 | Yoshii | |
| 4,904,233 | A | 2/1990 | Hakansson et al. | |
| 8,065,012 | B2 * | 11/2011 | Firlik et al. | 607/45 |
| 2004/0032962 | A1 * | 2/2004 | Westerkull | 381/151 |
| 2007/0053542 | A1 | 3/2007 | Lee | |
| 2007/0156011 | A1 * | 7/2007 | Westerkull | 600/25 |
| 2007/0191673 | A1 | 8/2007 | Ball et al. | |
| 2008/0312716 | A1 * | 12/2008 | Russell | 607/45 |

FOREIGN PATENT DOCUMENTS

| | | |
|---|---|---|
| WO | 0145457 | 6/2001 |
| WO | 2004014269 | 2/2004 |
| WO | 2004084583 | 9/2004 |
| WO | 2007078506 | 7/2007 |
| WO | 2007095196 | 8/2007 |

OTHER PUBLICATIONS

The European Search Report issued in connection with EP Application No. 09153215.0 mailed on Oct. 7, 2010.

* cited by examiner

*Primary Examiner* — Dao H Nguyen
(74) *Attorney, Agent, or Firm* — Gesmer Updegrove LLP

(57) ABSTRACT

A method and device for connecting a bone conductor transducer contained in a housing to the skull bone for the transmission of vibrations characterized by, that the housing has at least one surface, which is placed against the bottom plane of a recess shaped in the temporal bone with a static force exceeding the dynamic signal forces.

16 Claims, 9 Drawing Sheets

IMPLANTABLE TRANSDUCER

PRIORITY INFORMATION

The present application claims priority to Swedish Application No. SE0800390-7, filed on Feb. 20, 2008, which is incorporated herein by reference in its entirety.

DESCRIPTION

Technical Area

The following invention concerns a new method and device for connecting an implantable bone conduction transducer to the cranium for effective vibration transmission to the inner ear, which takes minimal space, has a low profile, allows for simple and safe surgical implantation and removal in the case of replacement or temporarily for a MRI examination.

Background of the Invention

In hearing aids of the bone conduction type the transducer was until the 1980s, applied against the skin behind the ear with a constant pressure that often was experienced as uncomfortable. The skin also dampened the vibration transmission, which made the sound quality generally poor. In the 1980s bone anchored hearing aids became available where the transducer was connected to a titanium implant anchored in the bone, see U.S. Pat. No. 4,498,461 and Håkansson et al. 1985. Since the housing of the device must not come in contact with the outer ear (due to feedback problems) the skin penetrating implant is placed approximately 55-60 mm behind the auditory canal slightly upwards and into the parietal bone, as is shown in FIG. 1 and described by Tjellström et al 2001.

In a bone anchored hearing aid the external sound processor with a built in transducer is connected and disconnected to a bone anchored implant on daily basis by the patient. The bone anchored implant consists of two parts; a bone screw which is anchored to the skull bone and a skin penetrating abutment connected to the bone screw. The skull bone consists of an inner and outer layer of compact bone tissue and a middle layer of spongy bone, which resembles a sponge with its inherent air cells. It is therefore important that the bone screw is set firmly in the compact outer bone tissue, so that it will grow properly together with the bone, a process called osseointegration.

There are several clinical drawbacks with skin penetrating (percutaneous) implants, see Reyes et al. 2006, Shirazi et al. 2006 and Tjellström et al. 2006. The bone screw can become loose either spontaneously or by an external impact against it. The skin penetrating area around the implant must be cared for daily as various degrees of infection can occur some of which require medical treatment. In the worst cases the implant must be removed. There are also some patients who feel stigmatized by the implant and some choose to decline the treatment on these grounds, see Burkey et al. 2006.

Recent studies have shown that sensitivity for bone conducted sound increases by 10-15 dB, if the connecting point for the transducer is removed from the parietal bone, where by today's standards the percutenous implants are placed, to the medial (inner) parts of the temporal bone and nearer the inner ear, see Stenfelt 2000 and Håkansson 2007.

Based on the above findings the bone anchored hearing aid has now been further developed, where the entire transducer is permanently implanted into the skull bone and electrical signal and energy are transmitted via an inductive link through intact skin, see Stenfelt 2000, Håkansson 2000, Holgers & Håkansson 2001, US 2007/0156011 A1 and US 2007/0191673 A1. In these proposals the signals and energy are transmitted via an inductive link consisting of an implanted receiving coil, as well as an external transmitting coil which are connected to the sound processor itself. As a result there is no need for a permanent penetration through the skin for vibration transmission and—at the same time—the outer sound processor can be made smaller since the transducer is now implanted. A drawback to this is that the inductive link results in a loss of 10-15 dB in sensitivity, which means that it is important to use the gain from moving the excitation point to the inner medial parts of the temporal bone, so that an implanted transducer is experienced as equally strong as a conventional bone anchored hearing aid, which uses a percutaneous implant. The inductive link transmits the signal via some form of conventional signal modulation e.g. amplitude modulation (AM), frequency modulation (FM) or pulse width modulation (PWM).

When the transducer is permanently implanted higher demands are set for the transducer's reliability and it must be smaller in seize and possibly have a higher level of effectiveness. An improved transducer called Balanced Electromagnetic Separation Transducer (BEST) has been developed to meet these demands see Pat No: SE 0000810-2, SE 0201441-3 and SE 0600843-7.

To date all known bone anchored hearing aids, facial prostheses and dental prosthesis's are anchored in the bone with the help of a screw attachment which osseointegrate with the skull bone in order to bear the static forces and transmit vibrations. The osseointegration of the screw attachment is itself considered a necessary prerequisite for a successful long term anchorage. Examples of solutions with screw attachment for percutaneous transmission to the skull bone are given in U.S. Pat. No. 4,498,461 and examples of solutions with screw attachment for implanted transducers are given in U.S. Pat. No. 4,904,233, US 2007/0156011 A1 and US 2007/0191673A1.

A significant feature among the known solutions for implanted transducers (U.S. Pat. No. 4,904,233, US 2007/0156011 A1 and US 2007/0191673A1) is that they are attached from the temporal or parietal bone's lateral side, that is to say into the outer compact bone wall to insure osseointegration. The drawback with these anchoring methods is that they cannot utilize the greater sensitivity that is available when the connecting point is placed in the medial (inner) parts of the temporal bone which is largely composed of spongy bone.

The use of a screw attachment of an implantable transducer to the temporal bone's inner medial part has been considered, but because of associated surgical risks it has been rejected. A drilled hole can damage underlying structures such as facial nerve, veins and semicircular canals. Also the spongy bone tissue of the temporal bone is considered as less suitable for optimal osseointegration and stable anchorage of the titanium implant.

U.S. Pat. No. 4,612,915 relates to another type of vibrator than the present one, viz. a Xomeds transcutaneous vibrator, consisting a inner yoke, an airgap to intact skin and an outer magnetic circuit. The inner yoke is thus not an vibrator. This way of designing a complete vibrator where the skin is part of the construction and design was not really successful, but has been dropped since 15 years. The differences between the present system and the Xomed vibrator has been described in detail in Håkansson, B. et al, (1990), Otolaryngology Head and Neck Surgery, 102: 339-344-Percutaneous vs Transcutaneous transducers for hearing by direct bone conduction.

An alternative method for connecting an implantable transducer to the temporal bone's inner medial part has been suggested by Håkansson 2000, where these drawbacks are avoided, see FIGS. 2*a* and *b*. In this method the anchorage of the screw is done in two steps. In the first, a bone screw is placed in the outer compact skull bone in the same way as with the bone anchored hearing aid, which does not present significant medical risks and insures safe osseointegration. In the next step, the bone graft where the bone screw has been installed is removed. Additional bone tissue is then removed in the temporal bone by the standard methods (by successive drilling of the skull bone) in order to create a space where the transducer and bone graft can be placed. The bone graft containing the bone screw is then placed directly against the bottom plane and fixed sideways with soft tissue (fat) against the surrounding bone wall with the transducer housing attached. The bone graft then needs some time to heal into place.

Preliminary studies have shown that such solutions provide a relatively safe, stable and long term anchorage to the bone, however, recovery is long and a relatively greater distance between the housing and the bone's bottom plane is required to accommodate both the bone screw and the coupling unit. A coupling unit is needed in order to remove the transducer for replacement or in the case of a MRI examination. As can be seen in FIG. 2*b* the coupling unit requires yet more space in the axial direction in addition to the bone transplant's length. It should be noted that the deeper one has to drill into the skull bone, the greater the risk that vital parts become damaged, and therefore the total height should be kept minimal. Included among the vital parts in this region are the facial nerve and semicircular canals with the balance organ.

SUMMARY OF THE INVENTION

The present invention solves the above problems by connecting the implanted transducer to the medial (inner) parts of the temporal bone by directly connecting the housing, which contains the transducer, to the bone for transmission of the vibrations via a surface of the housing. The housing is pressed with a static force against the bone, which is greater than the signal forces. By this non-screw attachment a height of at least 5-6 mm is saved. The solution demands that a seat is made in the temporal bone in the bottom plane to which the transducer's housing is attached. The transducer is thus not attached for vibration transmission with a conventional osseointegrated screw attachment, but by a static force pressing the transducer housing against the bone surface. Over time osseointegration can occur at the housing surface, however, the fastening effect becomes relatively low due to the flat surface design. The implanted transducer can thus be easily removed in the case of an MRI examination, or upgrading or replacement due to failure.

In a preferred embodiment the transducer housing has an attachment surface, which is located medially and below to the outer surface of the temporal bone and the static force is maintained with a compliant device on the lateral side of the housing, which is attached to the bone's outer surface. The attachment surface of the temporal bone in the bottom plane is first formed to fit the attachment surface of the transducer housing. This surface can be levelled and any cavities can be filled with bone chips from the drilling of the bone when the hole was made or with bone cement. The device which creates the static force can be made of an elastic material such as silicon, which is compressed by e.g. a band/bar or thread material which is fixed to the lateral side of the skull bone. The band/bar or thread material can also function as the elastic element. In a simplified embodiment suture threads can be used. If a band/bar material with screw attachment is used, it can also serve as a mechanical protection against external impact in the area and prevent damage to the transducer or the temporal bone from possible external force. Such a bone anchored band/bar also provides protection against the radiation of vibration energy from the transducer housing, which reduces the risk of feedback.

In another preferred embodiment the static force can be obtained by adjustable screws which are pressing the arms in a lateral direction against a fold formed in the skull bone's outer part.

In another preferred embodiment a receiving adapter of biocompatible material can be placed in the bottom of the recess, between the application surface of the transducer housing and the skull bone. One side of the adaptor can be formed so as to heal with the skull bone, while its other side connects to the transducer housing, which may be easily removed in the case of replacement or an MRI examination.

In another preferred embodiment the bone and the receiving adaptor are formed so that static anchorage in a radial direction is obtained by a clamp fitting in a groove against the skull bone. The anchorage here must be sufficiently strong in order to transmit the dynamic signal forces in an axial direction without distortion. The connection between the adaptor and the transducer housing can in this case be achieved with a mechanical coupling device such as e.g. snap design.

In one preferred embodiment, silicon casing surrounding the transducer housing can be designed to dampen vibrations when in contact with overlying skin, in order to further prevent acoustic radiation.

In summary, the present invention offers the following advantages over the solutions known to date:

- Maximum sensitivity is obtained because the transmission of vibration occurs medially and under the temporal bone's lateral (outer) side, that is to say nearer the inner ear.
- No screw attachment is required in the transmission of vibrations at the attachment surface between the transducer housing and the skull bone, which simplifies the surgical procedure and allows for easy mounting and dismounting in the case of replacement or a MRI examination.
- No specific coupling device is required which minimizes the height of the implanted unit.
- The outer surface of the transducer housing can be vibration insulated from the skin which reduces the risk of feedback and protects the temporal bone and the transducer against external mechanical stress or impact.

DEFINITIONS

Figure 1:
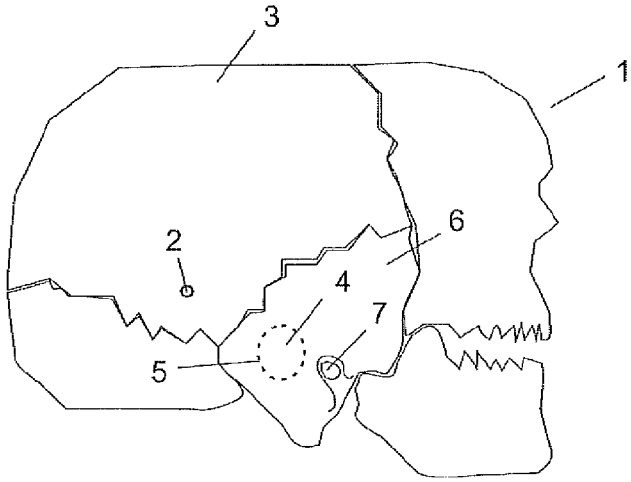
FIG. 1: Placement of the implants on the skull bone for connection of different types of implantable bone conducting hearing aids.

Definitions of terms and expressions used are here outlined in greater detail.

Osseointegration

Osseointegration indicates a process where, on the microscopic level, direct contact is established between living bone cells and the implanted screw surface.

Housing

A structure made of bio compatible material which hermetically capsulate the transducer and electronic components. The transducer can be of various types such as the conventional electromagnetic, BEST, FMT. In preferred embodiments the housing has at least one part that is intended for direct connection to the bone tissue or an adaptor made of biocompatible material, which can also connect to the bone tissue. The transducer itself can connect to the inside of the housing in different ways.

Biocompatible Material

Biocompatible material has minimal or no immunological or irritating effects on the surrounding tissue. Such material can be, although is not exclusively limited to, titanium, gold, platinum and ceramic.

Static Force

Static force refers to a force which presses the housing of the transducer against the skull bone, so that the dynamic signal forces generated by the transducer can be transmitted to the skull bone without distortion.

Signal Force

Signal force or dynamic force refers to those forces that the transducer generates, which are directly related to the sound at the microphone(s) inlet which is processed and fed to the power amplifier and the inductive link, to drive the transducer.

Inductive Link

Inductive link refers to a system for the transmission of electric signal through intact skin and soft tissue, consisting of an externally placed transmitting coil and an implanted receiving coil. The transmitting coil can be integrated with the sound processor, but it can also be separated and connected by a wire. There are electronic circuits on the sender side for the modulation of the signal to the carrier wave. On the implanted side there are electronic circuits for the demodulation of the signal and potential reception of the energy of the carrier wave to supply active electronics or to charge an implanted battery. The transmitting external coil and the implanted coil are kept in place and aligned by one or more magnets on the respective side.

Modulation

Modulation refers to some form of modulation where a high frequency carrier wave (0.05-10 MHz) is modulated with the sound signal (0.1-10 kHz) as by amplitude modulation (AM), frequency modulation (FM) or pulse width modulation (PWM).

Conventional Electromagnetic Transducer

Conventional electromagnetic transducer refers to an electromagnetic variable reluctance transducer with an air gap between the counter weight unit and yoke, which are connected to each other by a spring suspension device, which maintains the air gap. The yoke is connected to the mechanical load. Conventional electromagnetic transducers are used today e.g. in bone anchored hearing aids (BAHA) from Choclear Corp. or in the audiometric transducer type B71 from Radioear.

BEST

BEST refers to an electromagnetic variable reluctance transducer with counter acting air gaps for out-balancing of static forces and where the static and dynamic magnetic fluxes are separated except in and close to the air gaps, see Pat nr SE 0000810-2, SE 0201441-3 and SE 0600843-7.

FMT—Floating Mass Transducer

Electromagnetic transducer which is available in some varieties, where the basic common design is that the magnet is the counter weight mass and is suspended inside a bobbin case, see U.S. Pat. Nos. 5,554,096 and 5,897,486.

Piezoelectric Transducer

A piezoelectric transducer is created by laminating disks having piezoelectric properties with opposing polarities, so that the disks are bended when the voltage is applied.

Temporal Bone—Skull Bone

Most of the preferred embodiments above describe how the transducer housing is placed in the temporal bone, but the present invention can also refer to other locations on the skull where the bone is sufficiently thick.

DETAILED DESCRIPTION OF THE INVENTION

As is shown in FIG. 1 the skull (1) is composed of different bone plates which are held tightly together with so called sutures. In a conventional bone anchored hearing aid (BAHA) the bone screw (2) is placed in the parietal bone (3). In the present innovation the transducer is connected to the bottom plane (4) of the inner part of a recess (5) in the temporal bone (6). The recess is created directly behind the entrance of the ear canal (7) in that part of the temporal bone which is commonly referred to as the mastoid.

Figure 2A:
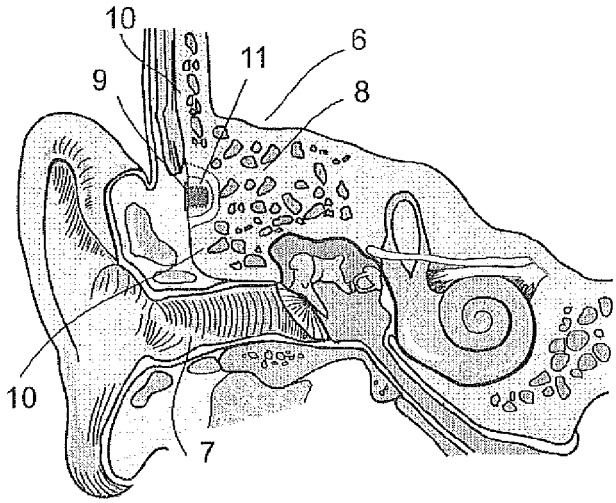
FIGS. 2*a, b*: A previous suggested type of attachment of an implanted transducer, in two steps, using an osseointegration screw attachment to a bone graft.
Figure 2B:
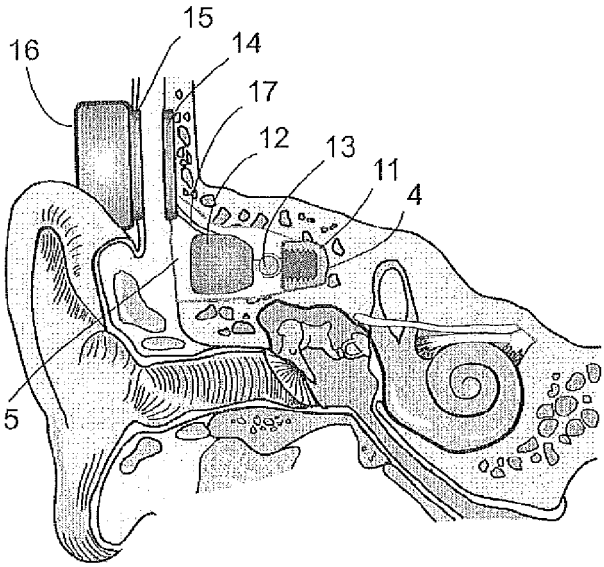

For medical reasons it is not custom to drill or screw a hole into the bottom plane of the recess (5) where the bone as shown in FIG. 2*a* consists of many air cells or so called spongy bone (8). Consequently it has been suggested that a bone screw (9) for attachment of an implantable transducer is first installed in the outer layer of compact bone (10) and then the surrounding bone is removed as a bone graft (11). Then a recess is drilled in the bone (5) and the bone graft (11) is adjusted to fit against the bottom plane (4) to which a housing (12) containing the transducer is connected via a coupling device (13) principally as illustrated in FIG. 2*b*. The transducer itself, which is enclosed in the housing (12) and can be attached to the housing in a number of different ways; front or rear side (medial or lateral) for example, is not shown in any of the figures, since it does not apply to the present invention. The transducer can be of arbitrary type like a conventional electromagnetic type like or BEST, floating mass type (FMT) or Piezoelectric.

It is already well-known that a complete hearing system of this kind, which is shown in FIG. 2*b*, also consists of an inductive link for the transmission of sound signals or energy to supply an implanted active power amplifier. The inductive link consists of an implanted receiving coil (14) and an externally supported transmitting coil (15). The transmitting coil can be entirely integrated with the sound processor (16). Integrated with the receiving coil (14) or the implanted transducer (12) there is also an electronic unit for demodulation of the inductively transmitted signal (not shown in FIG. 2*b*) and the components are connected electrically via a cable (17).

Figure 3A:
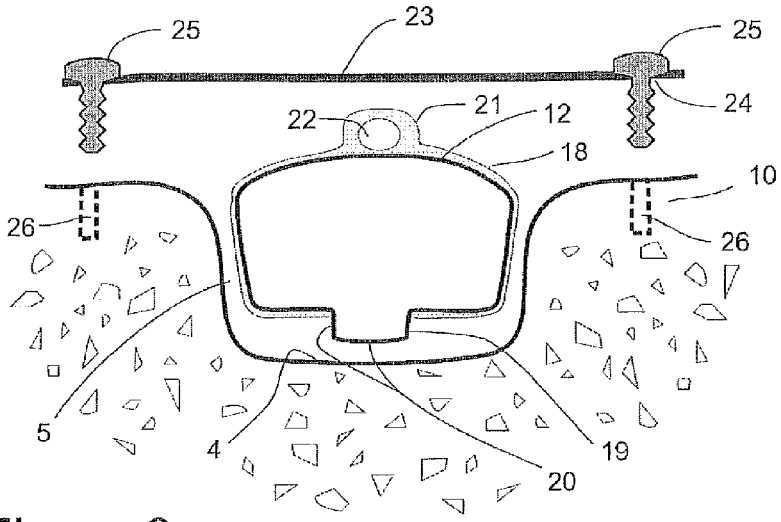
FIG. 3*a-d*: Schematic illustrations showing the attachment of a complete auditory system according to the present invention consisting of: (a) a transducer housing which is partly sealed in, for example, silicon and containing a transducer, is placed in a recess in the skull bone; (b) an open and biocompatible surface of the housing is pressed with force F against the bottom plane of the skull bone using a bar arrangement attached with orthopaedic screws; (c) an implanted receiving coil connected electrically via appropriate demodulation electronics; (d) an external sound processor including a transmitting coil is applied over the receiving coil with permanent magnets as retention elements.

In FIG. 3*a-d* schematic illustrations show how, according to one of the preferred embodiments of the present invention, a complete hearing system can be attached. FIG. 3*a* shows that the implantable housing (12) containing the transducer also has a protective encasement of for example silicon (18) with the exception of a protrusion (19) in the medial direction. This protrusion (19) has a biocompatible attachment surface (20) which will be attached to the skull bone for the transmission of signal vibrations. The biocompatible attachment surface (20) stretches across the transversal surface and the protrusion neck (19) as is indicated in FIG. 2*a*.

Figure 3B:
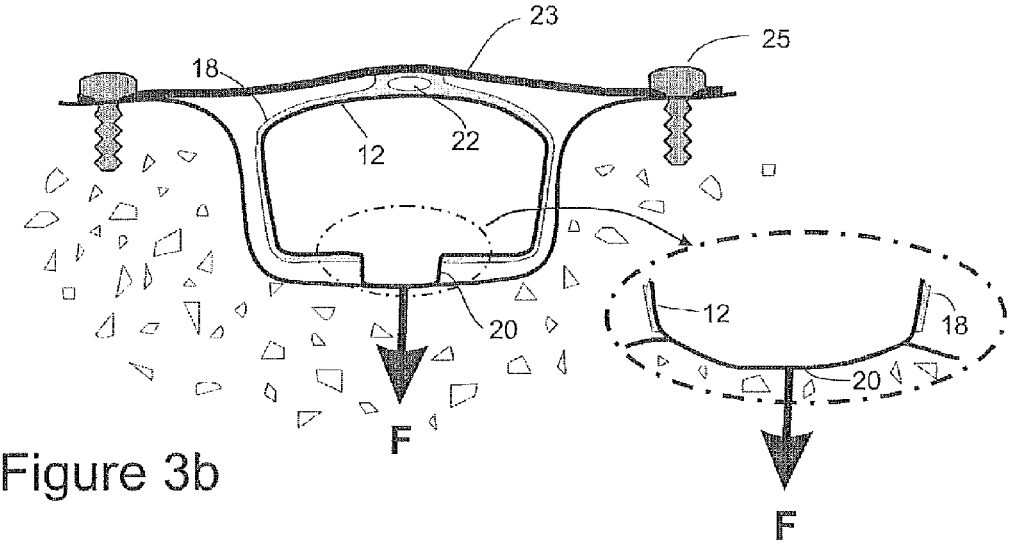

The attachment surface (20) of the transducer housing can have an arbitrary shape and cross section i.e. rectangular or round for example. Its size can range from a few $mm^2$ up to the entire cross section surface of the transducer housing, as is shown in the detail of FIG. 3*b*. After a longer time of use the bone and the attachment surface of the housing may osseointegrate, but the fixation in an axial direction is not critical as long as the F force is maintained, which also allows for easy removal of the transducer housing. When the appropriate healing period has elapsed, it is likely that the requirement on the contact force's F's size can be diminished. This is provided by a tight and moist attachment surface giving a rigid attachment in the same way as for example in a joint where the bone conduction vibrations can be transmitted without significant losses.

Figure 3C:
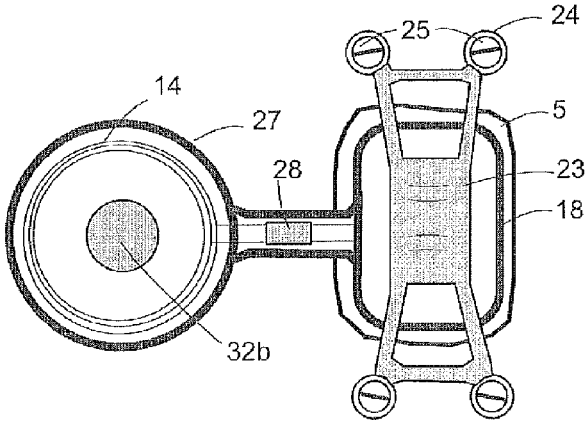

In FIG. 3*a* is also shown how the protective encasement (18) has an outgrowth of elastic material such as silicone (21) in a lateral direction with suitable elastic properties. The elastic outgrowth (21) can contain one or more air cells (22) and can stretch across the entire lateral side of the transducer housing. FIG. 3*b* shows how the fixation, between the biocompatible surface of the housing (20) and the bottom plane (4), are created in this preferred embodiment by having a bar plate (23) with holder ears (24) and with the aid of fastening screws (25) compressing the elastic encasement (18) and/or the elastic outgrowth (21) in a medial direction and against the bottom plane thus creating the force F. In FIG. 3*b* this is illustrated with the compressed air cells (22) and the slightly bent bar plate (23). The fixating screws (25) can be self threaded in order to obtain proper operations in pre-drilled holes (26) in the compact outer bone wall where no medical hazards are present. FIG. 3*c* shows that the implanted and encased transducer has a receiving coil (14) electrically connected and contained in a prolonged part (27) of the encasement (18). There is an electronic unit (28) with appropriate demodulation electronics and power electronics between the receiving coil (14) and the transducer. The electronic components can be integrated inside the transducer housing or in the receiving coil or between these two (only the last alternative is shown in FIG. 3*c*).

Figure 3D:
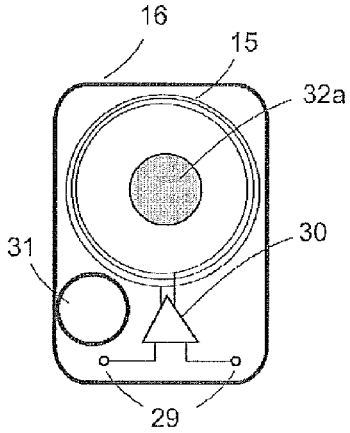

FIG. 3*d* shows the externally supported sound processor (16) which contains the transmitting coil (15). The sound processor (16) contains common hearing aid components such as one or more microphones (29), a signal processing unit (30), and battery (31). In order to firmly fasten and aligning the transmitting coil against the implanted receiving coil, one or more magnets (32*a, b*) are placed centrally in the transmitting coil and the receiving coil, respectively.

Figure 4:
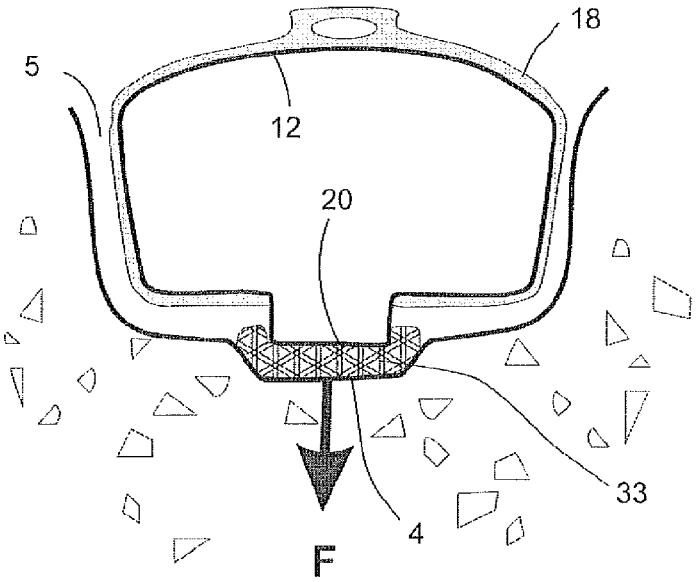
FIG. 4: Shows how the bottom plane in a recess of the skull bone is prepared using bone chips or a bone graft.

FIG. 4 shows how the bottom plane (4) can be prepared with the help of a biocompatible intermediate layer (33) between the bottom plane (4) and the attachment surface of the housing (20). The intermediate layer (33) can consist of bone chips or bone cement or another bone substitute such as Hydroxyl apatite (HA). A bone implant can also be taken from the outer compact layer of bone when the recess (5) is made. This compact bone transplant can then be adapted for use as the intermediate layer (33) allowing for a stable connection to the temporal bone with the individual's own compact bone tissue.

Figure 5A:
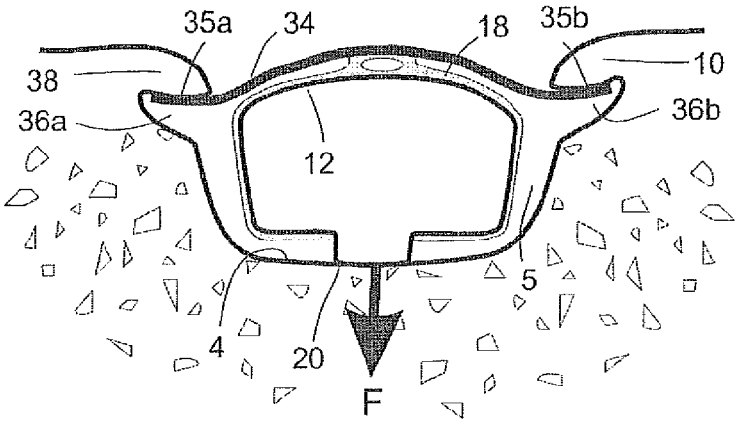
FIGS. 5*a, b*: Show how elastic arms of a metallic thread can be attached against a notch under the temporal bone's outer wall of compact bone with the help of elastic metallic thread material.
Figure 5B:
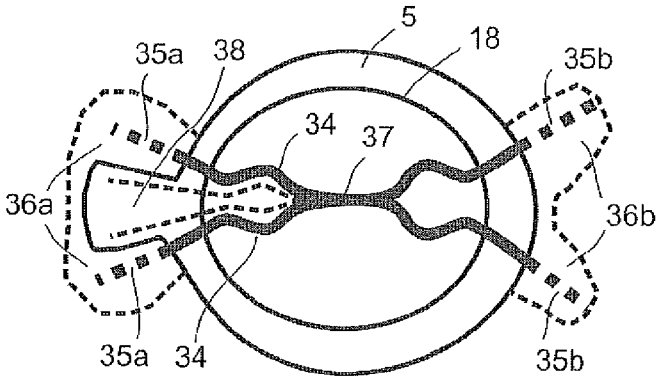

FIG. 5*a* shows an alternative method to attach the transducer house by use of elastic metallic wire elements (34), where their ends (35*a, b*) can be tightened and attached to the groove (36*a, b*) under the temporal bone's outer wall of compact bone (10). As is shown in FIG. 5*b* the thread element can be suitably joined in the middle part (37) by spot welding, for example, so that they create an H-form. Tracks can be formed in the encasement (18) and/or in its protrusion (21) in order to attach the wire element (not shown in FIGS. 5*a, b*). When tightening into the bone, one side of the wire ends (35*b*) can first be put in the groove (36*b*). The two other free wire ends (35*a*) are then pressed together (shown as a broken line in FIG. 5*b*) and thereafter placed through an opening (38) in the compact bone wall in order to then be secured in the groove (36*a*).

Figure 6A:
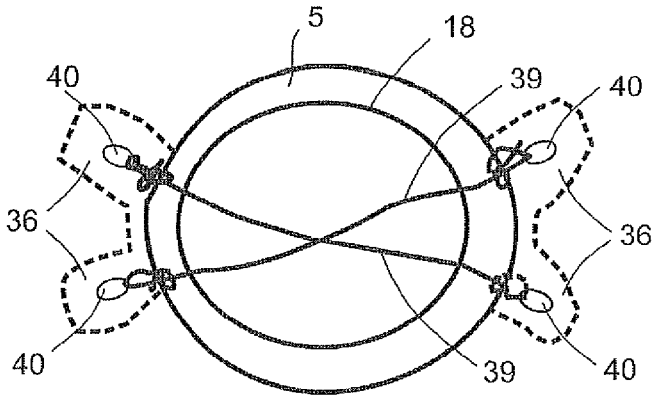
FIGS. 6*a, b*: Show how the implanted transducer is attached with suture threads (a) and how the transducer housing is held in place with the help of fat tissue, cartilage and outer soft tissue (b).
Figure 6B:
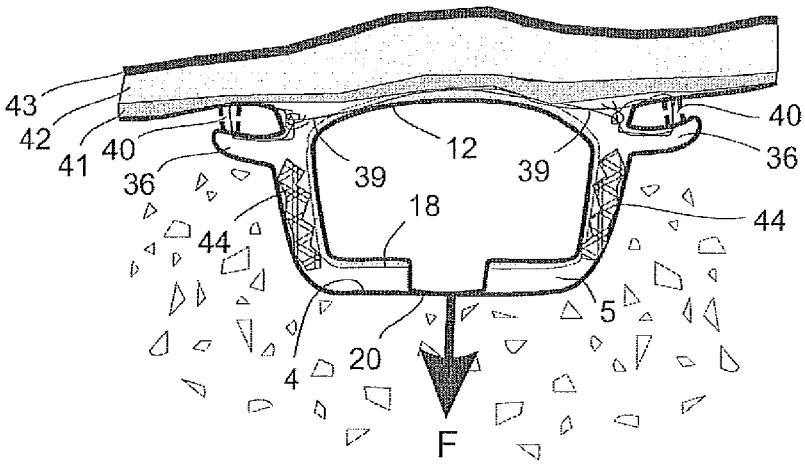

FIG. 6*a* shows another, simpler, preferred embodiment entailing that the wire elements (34) are substituted by suture threads (39). The suture threads are tied or attached through holes (40) in the outer bone that enters in the grooves (36). FIG. 6*b* shows that the contact force F is effected partly because the suture threads (39) are tightened over the encasement of the transducer housing (18) and because the periosteum (41) as well as the soft tissue (42) and outer skin (43) are sutured with a pressure acting in the medial direction against the implanted transducer housing. Since the fastening in this scenario is more fragile, the transducer's housing can be stabilized in the recess (5) with e.g. fat tissue (44) so that it will not move in a transversal (radial) direction. Such stabilization can be desirable in all of the models described above.

Figure 7:
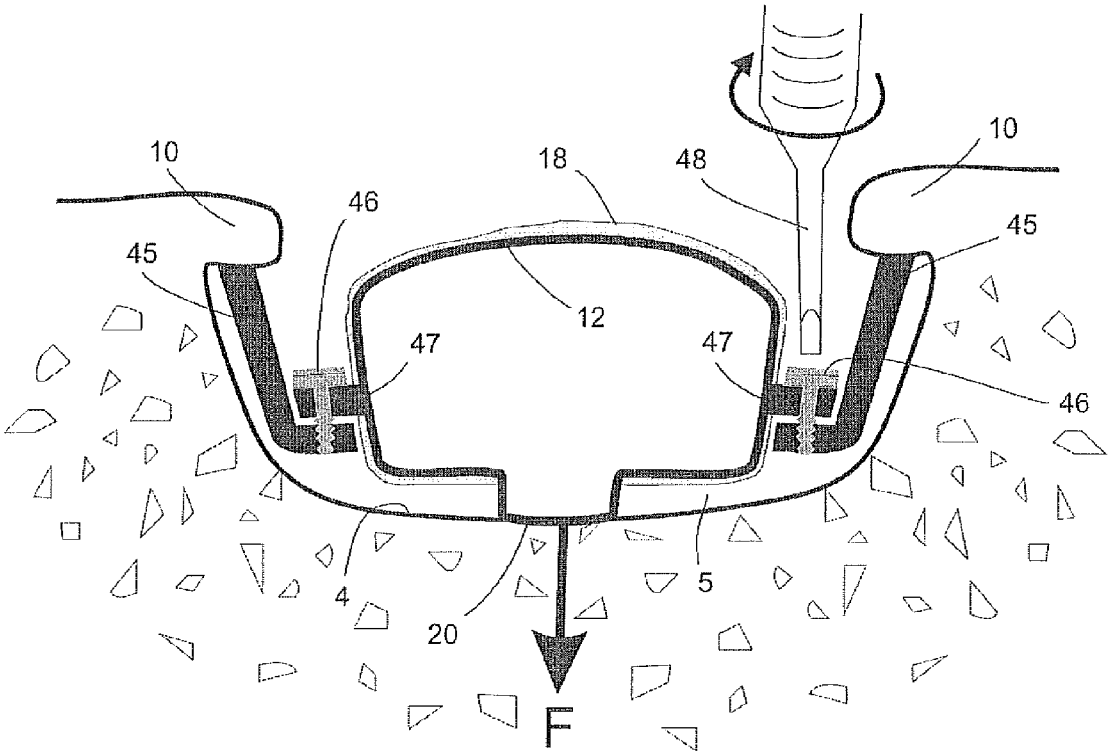
FIG. 7: Shows how the static force between the biocompatible surface of the housing and the skull bone can be generated with the help of a screw based adjustment device which act against a groove in the skull bone's outer wall of compact bone.

FIG. 7 shows how the static force can be generated with the help of a biocompatible screw based tightening device with arms (45) which attach against the temporal bone's compact outer bone wall (10) from the groove (36) in lateral direction. The attachment is made with a screw adjustment (46) which is put through a holder seat (47) integrated in the transducer housing (12) and which can press the arms (45) outward to maintain the force F with the aid of a screw driver (48).

Figure 8A:
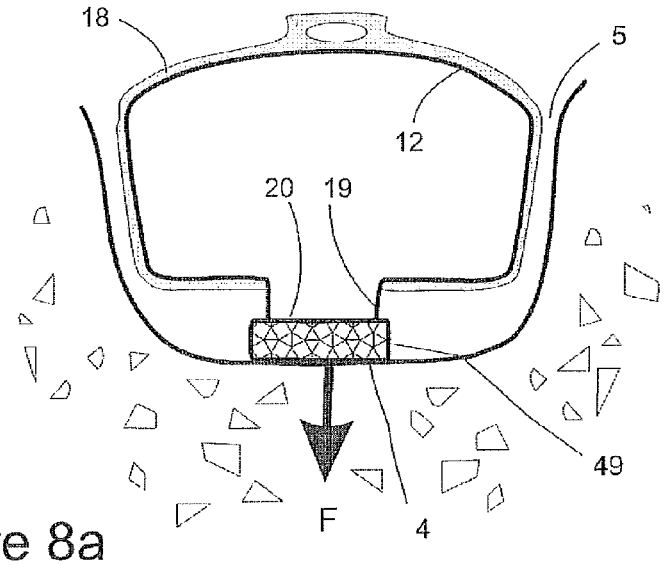
FIG. 8 *a-d*: Show a preferred embodiment where: (a) an adapter of biocompatible material is inserted to heal into the skull bone on its one side and where the transducer housing is connected to the other side; (b) the adaptor can have compliant arms for static tightening between the housing and the adaptor; (c) the adaptor can be rectangular and have holes in the plate for bone in growth; (d) the adaptor's shape is arbitrary and it can be for example circular.
Figure 8B:
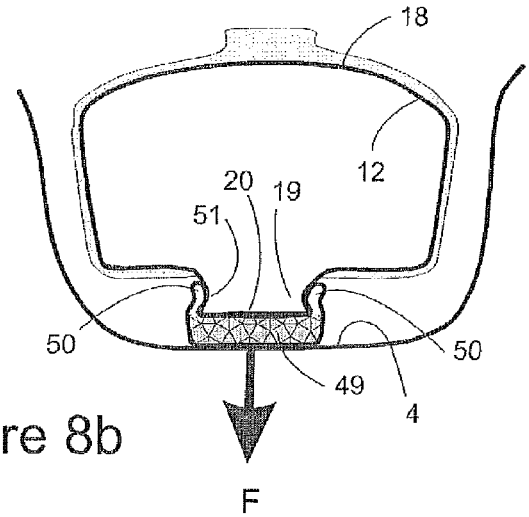
Figure 8C:
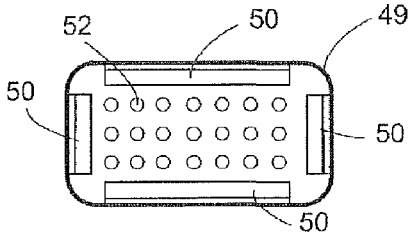
Figure 8D:
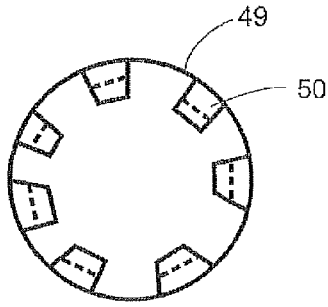

FIGS. 8*a-d* shows an embodiment where an adaptor (49) of bio compatible material is placed between the bone on the bottom plane (4) and the transducer housing's attachment surface (20). FIG. 8*b* shows how the adaptor (49) can have protruding elastic arms (50) for static coupling to the transducer housing (12) and for the transmission of the vibrations. The elastic arms can have a thinner cross section than the bottom plane. The protrusion (19) of the transducer housing can have indents (51) adapted to the elastic arms (50) so that these elastic arms (50) will be able to grip firmly to the housing. FIG. 8*c* shows how the adaptor (49) can have holes (52) in the plate to facilitate in growth of the bone tissue and in FIG. 8*d* it is shown that the adaptor (49) can be circular.

Figure 9:
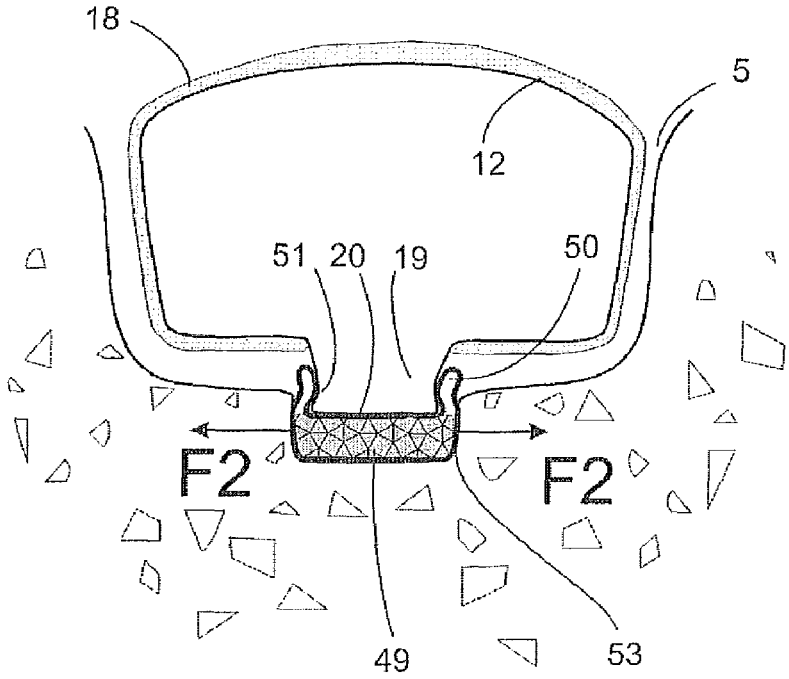
FIG. 9: Shows a preferred embodiment where the adaptor is squeezed in in a prepared notch in the bottom plane of the recess in the skull bone, which also statically fixates the adaptor in axial direction.

FIG. 9 shows a preferred embodiment where the adaptor (49) is pressed into a groove (53) in the bone of the bottom plane (4) where transversal forces F2 are built up which are strong enough to anchor the adaptor in the lateral-medial (axial) direction so that the signal forces can be transmitted from the housing (12) to the skull bone without distortion.

Although all of the embodiments above are presented to describe the invention, it is clear that the professional can modify, add to, combine or remove details without deviating from the invention's scope and essence as is defined by the following patent claims.

NUMBERED REFERENCE LIST

1 Skull, cranium
2 Bone screw for a BAHA
3 Parietal bone
4 Bottom plane of a recess in the temporal bone
5 Recess in the temporal bone
6 Temporal bone
7 Entrance of the ear (auditory) canal
8 Spongy bone
9 Bone screw
10 Outer compact bone
11 Bone graft with bone screw
12 Housing containing transducer
13 Coupling (connecting) device
14 Implanted receiving coil
15 External transmitting coil
16 Sound processor
17 Cable between transducer and receiving coil
18 Encasement of e.g. silicone
19 Protrusion of the transducer housing
20 Biocompatible attachment surface of the transducer housing
21 Protrusion (swelling) of housing encasement of e.g. silicone
22 Air cells
23 Leaf plate/bar plate
24 Holder ears for screw attachment
25 Attachment screws
26 Pre-drilled holes
27 Outstretched part of encasement in e.g. silicone
28 Demodulation and driving electronics
29 Microphones
30 Signal processing unit
31 Battery
32 Retention magnets
33 Biocompatible intermediate layer
34 Metallic wire
35 Wire ends
36 Groove (notch) in the temporal bone
37 Joint (connection) between the wire elements
38 Opening in the compact bone wall
39 Suture thread
40 Hole in the outer bone wall
41 Periosteum
42 Soft tissue
43 Skin
44 Fat tissue
45 Arms for tightening
46 Adjusting (regulating) screw
47 Holder seat of the housing
48 Screw driver
49 Adaptor
50 Elastic arms on the adaptor
51 Indent in the protrusion
52 Holes in the adaptor
53 groove in the bottom plane

REFERENCES

Tjellström, A., Håkansson, B. and Granström, G. (2001), The bone-anchored hearing aids—Current status in adults and children, Otolaryngologic Clinics of North America, Vol. 34, No 2, pp 337-364.

Håkansson, B. E. V. (2003). The balanced electromagnetic separation transducer a new bone conduction transducer. Journal of the Acoustical Society of America, 113(2), 818-825.

Reyes, R. A., Tjellström, A., Granström, G., 2000 Evaluation of implant losses and skin reactions around extra oral bone-anchored implants: A 0- to 8-year follow-up, Otolaryngol. Head Neck Surg. 122(2), 272-276.

Håkansson, B., Tjellström, A., Rosenhall, U. and Carlsson, P., 1985, The Bone-Anchored Hearing Aid. Acta. Otolaryngol. 100:229.

Tjellström A, Granström G. How we do it: Frequency of skin necrosis after BAHA surgery. Clinical Otolaryngology 2006; 31:216-220.

Shirazi M, Marzo S, Leonetti J. Perioperative complications with the bone-anchored hearing aid. Otolaryngology—Head and Neck Surgery 2006; 134:236-239.

Burkey J, Berenholz L, Lippy W. Latent demand for the bone-anchored hearing aid: the Lippy Group experience. Otology & Neurotology 2006; 27(5):648-652.

Stenfelt, S., Håkansson, B., and Tjellström, A., 2000, Vibration characteristics of bone conducted sound in vitro J. Acoust. Soc. Am. 107(1), 422-431.

Håkansson, B., 2000, Implanterbara hörapparater, Audionomen nr 4, 11-17.

Holgers, K. M., and Håkansson, B., 2001, Titanium in audiology, in Titanium in medicine, edited by D. M. Brunette, P. Tengvall, M. Textor and P. Thomsen, Springer, Berlin, 909-928.

Håkansson B., Eeg-Olofsson M., Reinfeldt S., Stenfelt S., Granström G., "A transcutaneous bone conduction hearing device—a feasibility study of a complete system", First international symposium: Bone conduction hearing and osseointegration, 2007, Halifax, Nova Scotia, Canada.

SE Patent No: 81-07161-5 A coupling for bone conduction hearing aids

SE Patent No: 0000810-2 An electromagnetic transducer

SE Patent No: 0201441-3 Device at electro magnetic transducer

SE Patent No: 0600843-7 Method for the manufacture of balanced transducers

SE patent No: 8502411-5 Test equipment for direct bone conduction device

The invention claimed is:

1. A method for connecting a bone conductor transducer contained in a housing to the skull bone for the transmission of vibrations, wherein at least one attachment surface of said housing in a non-screw attachment, is brought into contact against a bottom plane of a recess formed in said skull bone, said contact exerting a static force F exceeding dynamic signal forces produced by the transducer, thereby transmitting the vibrations directly to the skull bone via the surface of the housing.

2. The method according to claim 1, wherein the bottom plane of the recess formed in said skull bone at the attachment surface is prepared with a biocompatible intermediate layer consisting of e.g. bone chips, bone graft, bone cement or another bone substitute.

3. The method according to claim 1, wherein an adaptor having a medial side is placed between the attachment surface of the housing and the skull bone, said medial side is placed against the bottom plane of said recess made in the skull bone with a static force F exceeding the dynamic signal forces of the transducer.

4. The method according to claim 1, wherein the static force F between the housing or an adaptor and the bottom plane of the recess formed in said skull bone develops through pressing the housing or the adaptor into place in a groove in the bottom plane of the recess of the skull bone.

5. The method according to claim 1, wherein the static force F is generated by compressing an elastic encasement of the transducer housing on the lateral side by a leaf/bar plate anchored in the bone wall or an metallic wire.

6. The method according to claim 1, wherein the static force F is generated by arms which work in a lateral direction via adjusting screws through a holder seat in the housing via arms acting against the outer compact bone wall.

7. The method according to claim 1, wherein the static force F is generated by pressure, which is provided by tightening suture threads over the encasement that are the anchored in the outer bone wall and where with skin and underlying soft tissue are lying close against the encasement on its lateral side.

8. The method according to claim 1, wherein the recess is made in the temporal bone.

9. A device comprising a bone conductor transducer contained in a housing with at least one attachment surface for the transmission of vibrations to a skull bone, wherein the housing has arrangements that in a non-screw attachment, produces a static force F between said housing and a bottom plane of a recess formed in said skull bone, said static Force F exceeding dynamic signal forces produced by the transducer, and thereby transmitting vibrations directly to the skull bone via the surface of the housing.

10. The device according to claim 9, wherein an elastic encasement on the lateral side of the transducer housing is compressed by a leaf plate/bar anchored in the bone wall or a metallic wire in biocompatible material in order to generate the static force F between said housing and the bottom plane of the recess formed in said skull bone.

11. The device according to claim 9, wherein the static force F is generated by pressure, from tightening of suture threads over the encasement, said suture threads are fastened in the outer bone wall or periosteum and that the skin and underlying soft tissue lie close against the encasement on its lateral side.

12. The device according to claim 9, wherein the bottom plane of the recess formed in said skull bone at the attachment surface is prepared with an intermediate layer of biocompatible material consisting of bone chips, bone graft, bone cement or other bone substitute.

13. The device according to claim 9, wherein the static force F is devised to be generated by arms which work in the lateral direction, via adjusting screws through a holder seat in the housing, and are acting against the outer compact bone wall.

14. The device according to claim 13, wherein said adaptor has holes for in growth of bone tissue.

15. The device according to claim 13, wherein said adaptor and the housing can be easily separated from each other by the coupling elements.

16. The device according to claim 9, wherein an adaptor having a medial side is devised to be placed between the attachment surface of the housing and the bottom plane of the recess formed in said skull bone, said medial side is placed against the bottom plane in said recess made in the skull bone with a static force F exceeding the dynamic signal forces.

* * * * *